US008844447B2

(12) United States Patent
Goding

(10) Patent No.: US 8,844,447 B2
(45) Date of Patent: Sep. 30, 2014

(54) FRAME FOR RAILWAY TRUCK

(75) Inventor: David J. Goding, Palos Park, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 193 days.

(21) Appl. No.: 13/409,079

(22) Filed: Feb. 29, 2012

(65) Prior Publication Data

US 2013/0220165 A1 Aug. 29, 2013

(51) Int. Cl.
*B61F 5/52* (2006.01)
*B61F 5/26* (2006.01)

(52) U.S. Cl.
CPC .... *B61F 5/52* (2013.01); *B61F 5/26* (2013.01)
USPC ..... 105/172; 105/218.1; 105/182.1; 105/206.1

(58) Field of Classification Search
CPC ..... B61F 5/24; B61F 5/26; B61F 5/28; B61F 5/30; B61F 5/32; B61F 5/52; B61F 3/04
USPC ..... 105/158.1, 158.2, 172, 174, 182.1, 194, 105/199.1, 199.4, 199.3, 200, 204, 205, 105/206.1, 206.2, 226, 227, 230, 229
See application file for complete search history.

(56) References Cited

U.S. PATENT DOCUMENTS

| | | | | | |
|---|---|---|---|---|---|
| 72,796 | A | * | 12/1867 | Carkeet | 384/282 |
| 1,994,304 | A | * | 3/1935 | Devlin | 105/194 |
| 2,556,952 | A | * | 6/1951 | Wojtowicz | 105/157.2 |
| 3,402,679 | A | | 9/1968 | Christian et al. | |
| 3,406,439 | A | | 10/1968 | Hutchens | |
| 4,242,966 | A | * | 1/1981 | Holt et al. | 105/182.1 |
| 4,485,743 | A | | 12/1984 | Roush et al. | |
| 4,628,824 | A | | 12/1986 | Goding et al. | |
| 4,679,506 | A | | 7/1987 | Goding et al. | |
| 4,679,507 | A | | 7/1987 | Rassaian | |
| 4,765,250 | A | | 8/1988 | Goding | |
| 4,841,873 | A | | 6/1989 | Goding et al. | |
| 5,085,151 | A | * | 2/1992 | Wako et al. | 105/206.1 |

(Continued)

FOREIGN PATENT DOCUMENTS

| | | | |
|---|---|---|---|
| EP | 2258597 | | 12/2010 |
| JP | 53 13709 | * | 2/1978 |
| WO | 2008070953 | | 6/2008 |

OTHER PUBLICATIONS http://www.railroadforums.com/photos/data/589/1123_731_nova_granja_03jun2005.jpg (visited Feb. 21, 2012).

(Continued)

*Primary Examiner* — Mark Le
(74) *Attorney, Agent, or Firm* — Finnegan, Henderson, Farabow, Garrett & Dunner LLP

(57) ABSTRACT

A frame for use with a railway truck may have a pivot housing, a first arm member extending outward from the pivot housing and having opposing distal ends, and a second arm member substantially identical to the first arm member and extending outward from the pivot housing opposite the first arm member. Each of the first and second arm members may have a generally planar upper plate, a generally planar lower plate, and plurality of webs vertically disposed between the generally planar upper and lower plates. An upper surface of the pivot housing may be generally co-planar with the generally planar upper plates of the first and second arm members.

19 Claims, 6 Drawing Sheets

(56) References Cited

U.S. PATENT DOCUMENTS

| | | | | |
|---|---|---|---|---|
| 5,509,359 | A * | 4/1996 | Houston | 105/225 |
| 5,546,869 | A | 8/1996 | Nassar | |
| 5,613,444 | A | 3/1997 | Ahmadian et al. | |
| 5,746,135 | A | 5/1998 | Ahmadian et al. | |
| 6,871,598 | B2 | 3/2005 | Schaller et al. | |
| 2005/0183625 | A1 | 8/2005 | Goding et al. | |

OTHER PUBLICATIONS http://www.railpictures.net/images/d1/2/4/3/8243.1296750113.jpg (visited Feb. 21, 2012).
Pending U.S. Patent Application, entitled "Railway Truck Having Axle-Pinned Equalizer,", filed Feb. 29, 2012.
Pending U.S. Patent Application, entitled "Railway Truck Having Equalizer-Linked Frame,", filed Feb. 29, 2012.
Pending U.S. Patent Application, entitled "Railway Truck Having Spring-Connected Equalizer and Frame,", filed Feb. 29, 2012.
http://www.railroadforums.com/photos/data/589/1123_731_nova_granja_03jun2005.jpg (prior to Feb. 21, 2012).
http://www.railpictures.net/images/d1/2/4/3/8243.1296750113.jpg (prior to Feb. 21, 2012).
U.S. Appl. No. 13/409,100, entitled "Railway Truck Having Axle-Pinned Equalizer,", filed Feb. 29, 2012.
U.S. Appl. No. 13/409,101, entitled "Railway Truck Having Equalizer-Linked Frame,", filed Feb. 29, 2012.
U.S. Appl. No. 61/634,534, entitled "Railway Truck Having Spring-Connected Equalizer and Frame,", filed Feb. 29, 2012.
U.S. Appl. No. 13/409,102, entitled "Railway Truck Having Spring-Connected Equalizer and Frame,", filed Mar. 1, 2012.

* cited by examiner

FRAME FOR RAILWAY TRUCK

TECHNICAL FIELD

The present disclosure relates generally to a frame and, more particularly, to a frame for a railway truck.

BACKGROUND

Locomotives traditionally include a car body that houses one or more power units of the locomotive. The weight of the car body is supported at either end by trucks that transfer the weight to opposing rails. The trucks typically include cast steel frames that provide a mounting for traction motors, axles, and wheel sets. Locomotives can be equipped with trucks having two, three, or four axles. An example of a four-axle locomotive truck is disclosed in U.S. Pat. No. 4,485,743 that issued to Roush et al. on Dec. 4, 1984.

Each truck frame of a typical locomotive is connected to its corresponding axle by coil springs that act directly on a journal box of each wheel. The journal box transmits vertical loads through the springs to the wheels and provides a housing for axle bearings. Pedestals are attached to the truck frame and hold the truck frame in place relative to the journal box while permitting some vertical movement of the truck frame. The pedestals transfer tractive and transverse loads to the wheels via the journal box. In some applications, an equalizer extends between the journal boxes of different wheels to equalize loads from the truck frame on the wheels. Rounded surfaces at ends of the equalizer typically rest on top of a wear plate attached to the journal box.

Conventional truck frames generally extend a significant distance past the associated axles to accommodate the pedestals described above. Such truck frames are also often multi-level and have interrupted geometry that avoids interference with various components and/or provides force transfer paths between the components. These numerous transitions and interrupted geometry can result in increased structural stress and reduce a durability of the truck frame.

The frame of the present disclosure solves one or more of the problems set forth above and/or other problems in the art.

SUMMARY

In one aspect, the present disclosure is related to a frame for a railway truck. The frame may include a pivot housing, a first arm member extending outward from the pivot housing and having opposing distal ends, and a second arm member substantially identical to the first arm member and extending outward from the pivot housing opposite the first arm member. Each of the first and second arm members may include a generally planar upper plate, a generally planar lower plate, and plurality of webs vertically disposed between the generally planar upper and lower plates. An upper surface of the pivot housing may be generally co-planar with the generally planar upper plates of the first and second arm members.

In another aspect, the present disclosure may be related to another frame for a railway truck. The frame may include a pivot housing, a first arm member extending outward from the pivot housing and having opposing distal ends, and a second arm member substantially identical to the first arm member and extending outward from the pivot housing opposite the first arm member. The frame may also include a plurality of brackets connected to the distal ends of the first and second arm members. The plurality of brackets connected to the distal ends of the first arm member may face inward toward the plurality of brackets connected to the distal ends of the second arm member.

DETAILED DESCRIPTION

Figure 1:
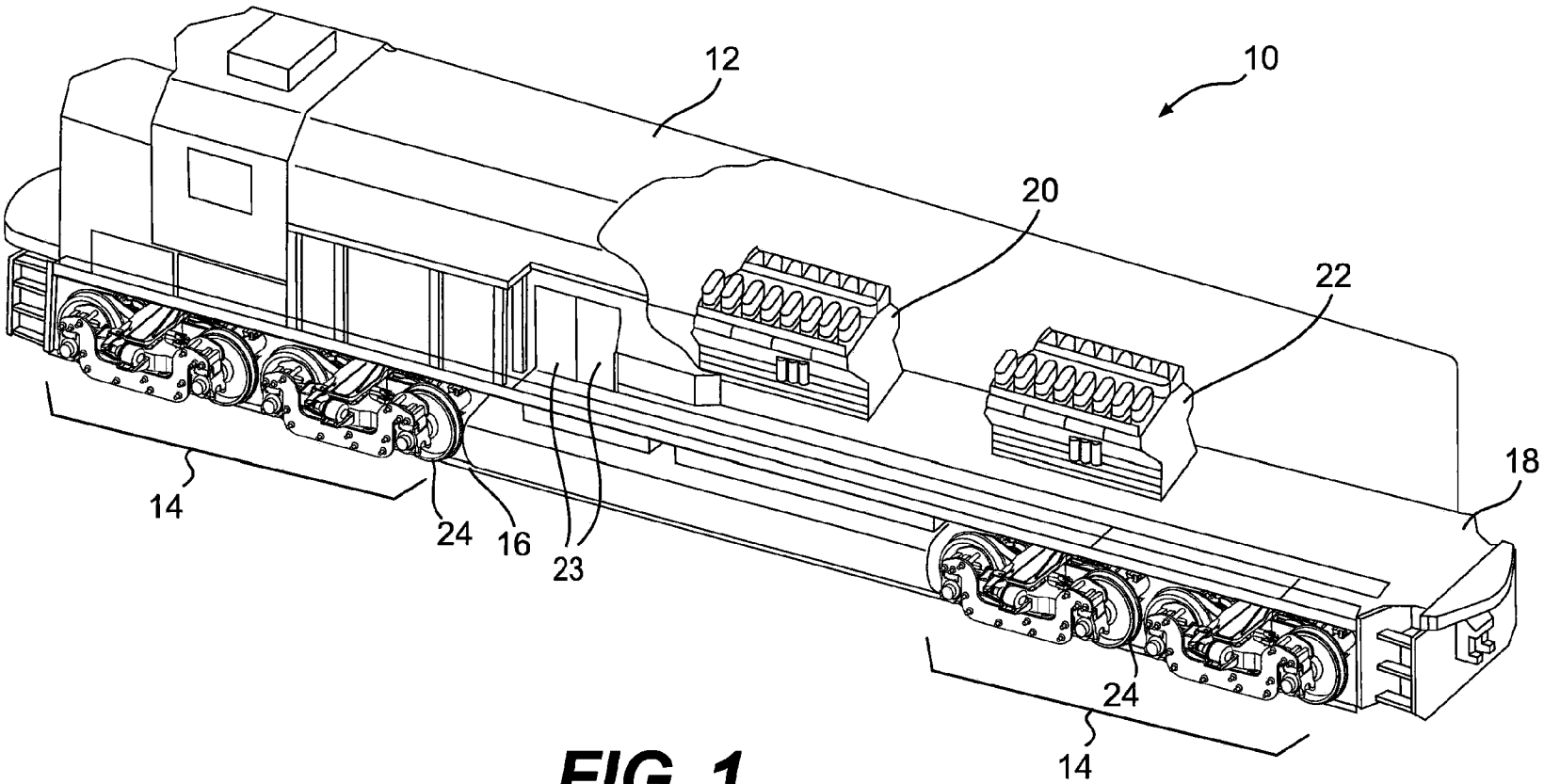
FIG. 1 is a pictorial illustration of an exemplary disclosed locomotive.

FIG. 1 illustrates an exemplary embodiment of a locomotive 10 that includes a car body 12 supported at opposing ends by a plurality of trucks 14 (e.g., two trucks 14). Each truck 14 may be configured to engage a track 16 and support a base platform 18 of car body 12. Any number of engines may be mounted to base platform 18 and configured to drive a plurality of wheels 24 included within each truck 14. In the exemplary embodiment shown in FIG. 1, locomotive 10 includes a first engine 20 and a second engine 22 that are lengthwise aligned on base platform 18 in a travel direction of locomotive 10. One skilled in the art will recognize, however, that first and second engines 20, 22 may be arranged in tandem, transversally, or in any other orientation on base platform 18.

Car body 12 may be fixedly or removably connected to base platform 18 to substantially enclose first and second engines 20, 22, while still providing service access to first and second engines 20, 22. For example, car body 12 may be welded to base platform 18 and include one or more access doors 23 strategically located in the vicinity of first and second engines 20, 22. Alternatively, car body 12 may be attached to base platform 18 by way of fasteners such that portions or all of car body 12 may be completely removed from base platform 18 to provide the necessary access to first and second engines 20, 22. It is contemplated that car body 12 may alternatively be connected to base platform 18 in another manner, if desired.

Figure 2:
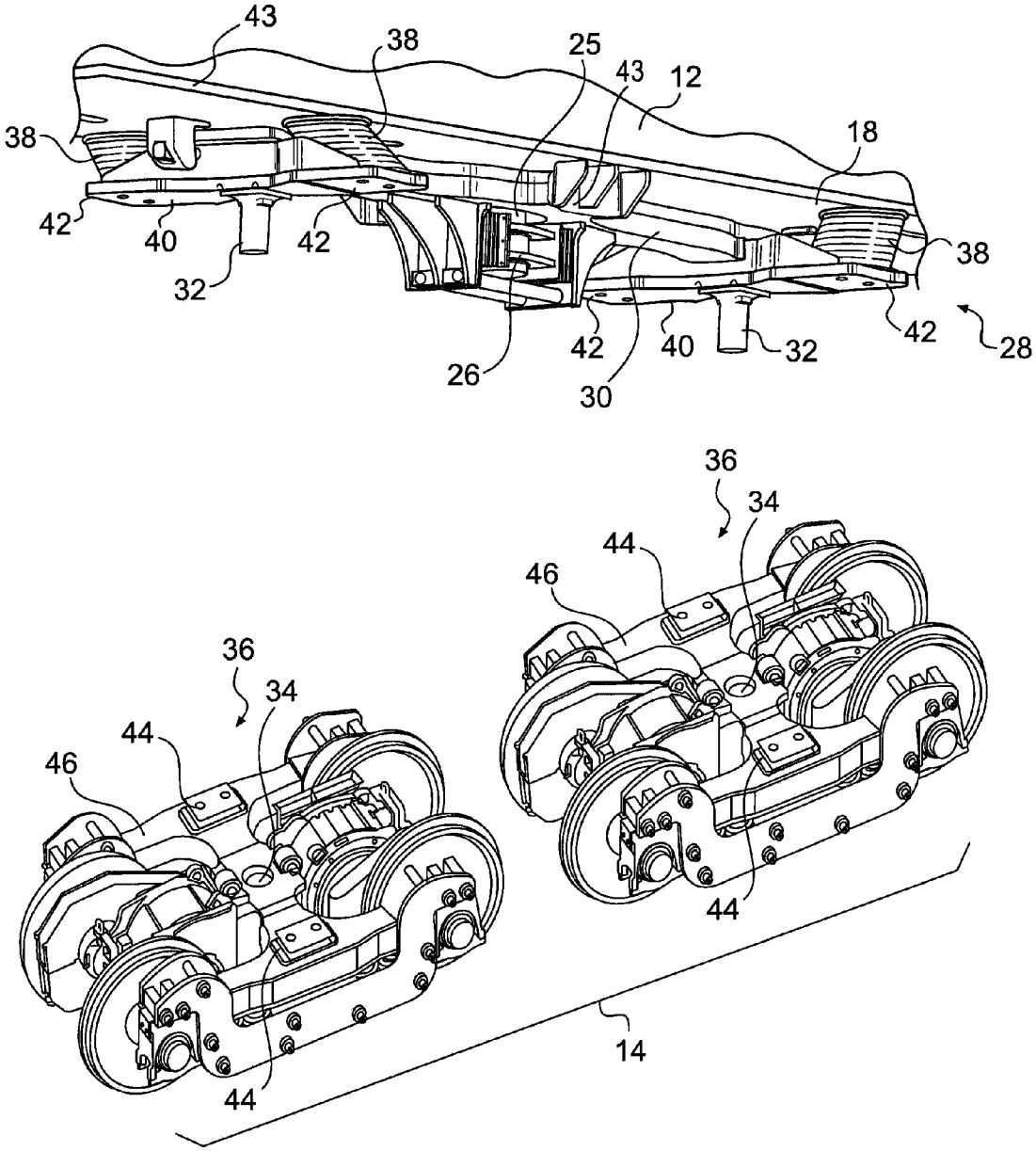
FIG. 2 is a semi-exploded diagrammatic illustration of an exemplary disclosed truck that may be used in conjunction with the locomotive of FIG. 1.

Base platform 18 may be configured to pivot somewhat relative to trucks 14 during travel of locomotive 10 along a curving trajectory of tracks 16. As shown in FIG. 2, base platform 18 may be provided with a pivot shaft 25 at each end (only one end shown in FIG. 2) that extends downward from a transverse center to engage a bearing 26 within a bolster assembly 28. Bolster assembly 28 may include a generally flat beam (also known as a span bolster) 30 that is rigidly or flexibly connected to bearing 26 and extends in a lengthwise direction of base platform 18. Additional pivot shafts 32 may extend downward from opposing ends of span bolster 30 away from car body 12 to engage pivot housings 34 within separate bogies 36 of each truck 14, thereby pivotally linking bogies 36 together and to car body 12. In this configuration, car body 12 and bogies 36 may all pivot independently relative to bolster assembly 28, allowing locomotive 10 to follow a curving trajectory of tracks 16. Pivot shaft 25 may be designed to transmit tractive forces (i.e., forces in a fore/aft direction, including propelling and braking forces) and lateral (i.e., side-to-side) forces between car body 12 and span bolster 30, with minimal transmission of vertical forces (i.e., weight of locomotive 10). Similarly, pivot shafts 32 may be designed to transmit these same tractive and lateral forces between span bolster 30 and bogies 36, with minimal transmission of vertical forces.

Span bolster 30 may be spaced apart from base platform 18 by way of a plurality of resilient members (e.g., springs) 38 located in pairs in general fore/aft alignment with pivot shafts 32 at the sides of base platform 18. In particular, bolster assembly 28 may include transverse arms 40 located at the ends of span bolster 30 and rigidly connected to pivot shafts 32. Springs 38 may be sandwiched between distal tips 42 of arms 40 and an underside of base platform 18. In the disclosed embodiment, springs 38 may include rubber compression pads that are removably connected to arms 40 of span bolster 30 and pinned to base platform 18, although other configurations of springs 38 may also be utilized. Springs 38 may be configured to undergo a shearing motion during pivoting of base platform 18 relative to span bolster 30. One or more limiters 43 may be rigidly connected to the underside of base platform 18 and configured to vertically retain span bolster 30 in location relative to base platform 18 and/or to limit a maximum amount of relative pivoting between base platform 18 and bolster assembly 28 (i.e., to limit a maximum shearing of springs 38). Springs 38 may be configured to transmit vertical forces between car body 12 and span bolster 30, with minimal transmission of tractive or lateral forces.

Span bolster 30 may be similarly spaced apart from bogies 36 by way of additional resilient members (e.g., springs) 44 located in pairs in general fore/aft alignment with pivot housings 34 at the sides of bogies 36. In particular, springs 44 may be removably connected to a frame 46 of each bogie 36 and pinned to an underside of span bolster 30 (e.g., to an underside of arms 40) in the same manner that springs 38 are connected to arms 40 and pinned to car body 12. Similar to springs 38, springs 44 may be rubber compression pads that are configured to undergo a shearing motion during lateral displacement (i.e., pivoting) of bogies 36 relative to span bolster 30. In this configuration, springs 44 may be configured to transmit vertical forces between bogies 36 and span bolster 30, with minimal transmission of tractive or lateral forces.

Springs 44 may be located immediately below springs 38 to reduce stresses induced within span bolster 30 by vertical forces. In particular, vertical forces from frame 46 may pass through springs 44 and then through springs 38 into base platform 18, with reduced transmission of forces in transverse directions through span bolster 30. This configuration may help reduce distortion of span bolster 30 due to vertical force transmission.

Figure 3:
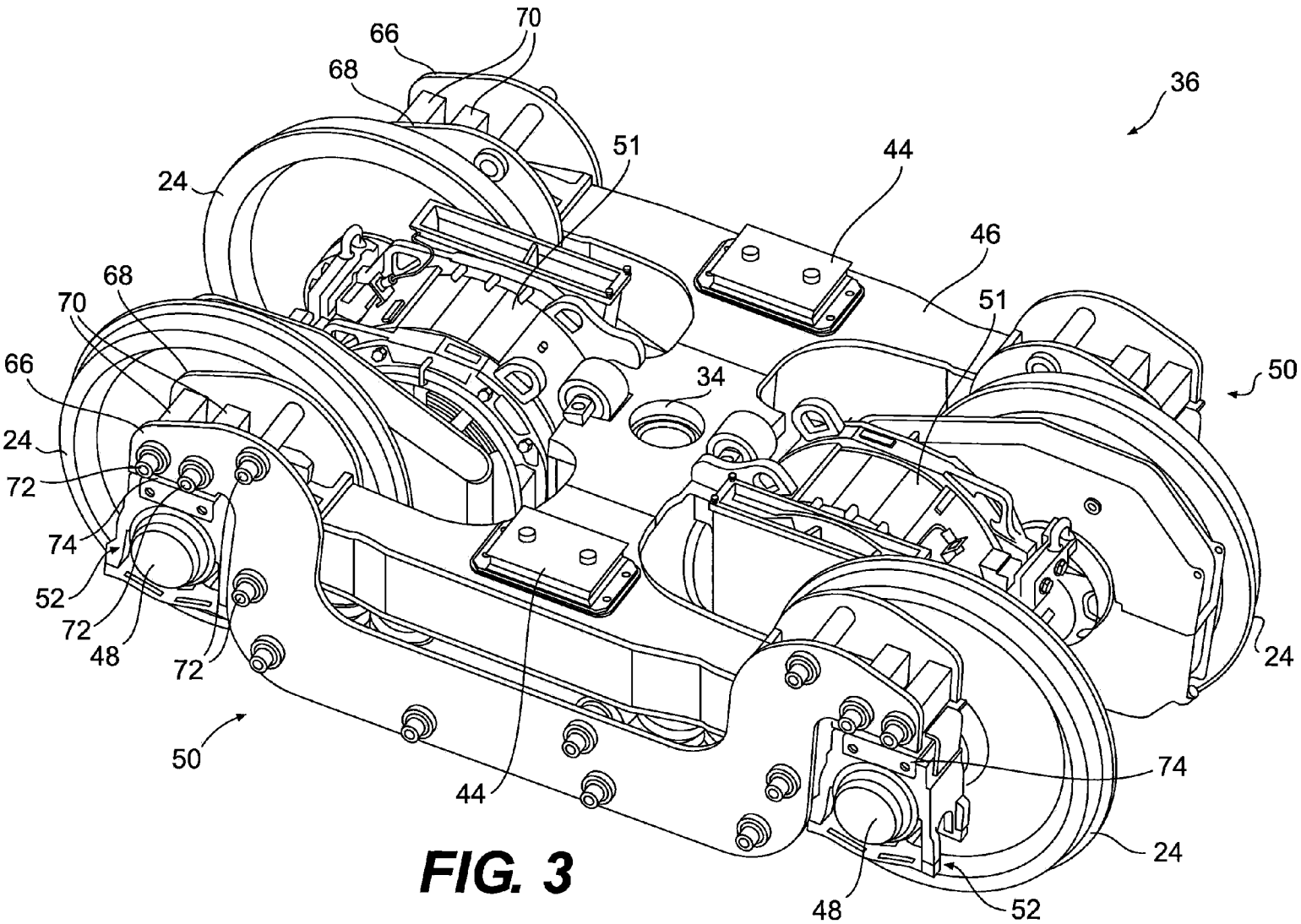
FIG. 3 is a pictorial illustration of an exemplary disclosed bogie that may be used in conjunction with the truck of FIG. 2.

An exemplary embodiment of one bogie 36 of truck 14 is shown in FIG. 3. It should be noted, however, that all bogies 36 within locomotive 10 may be substantially identical. Each bogie 36 may be an assembly of components that together transfers lateral, tractive, and vertical forces between tracks 16 and car body 12. For example, each bogie 36 may include, among other things, wheels 24, a plurality of axles 48 connected between opposing wheels 24, frame 46, and an equalizer 50 located at each side of bogie 36 to connect wheels 24 with frame 46 and to help distribute vertical loads between axles 48.

Two wheels 24 may be rigidly connected at the opposing ends of each axle 48 such that wheels 24 and axles 48 all rotate together. A traction motor 51, for example an electric motor driven with power generated by first and second engines 20, 22 (referring to FIG. 1), may be disposed at a lengthwise center of each axle 48, connected to frame 46 via pivot housing 34, and configured to drive wheels 24 via axles 48. The opposing ends of axles 48 may be held within separate bearing assemblies 52 such that forces (i.e., lateral, tractive, and vertical forces) may be transferred from wheels 24 through axles 48 and bearing assemblies 52 to the remaining components of bogie 36.

Figure 4:
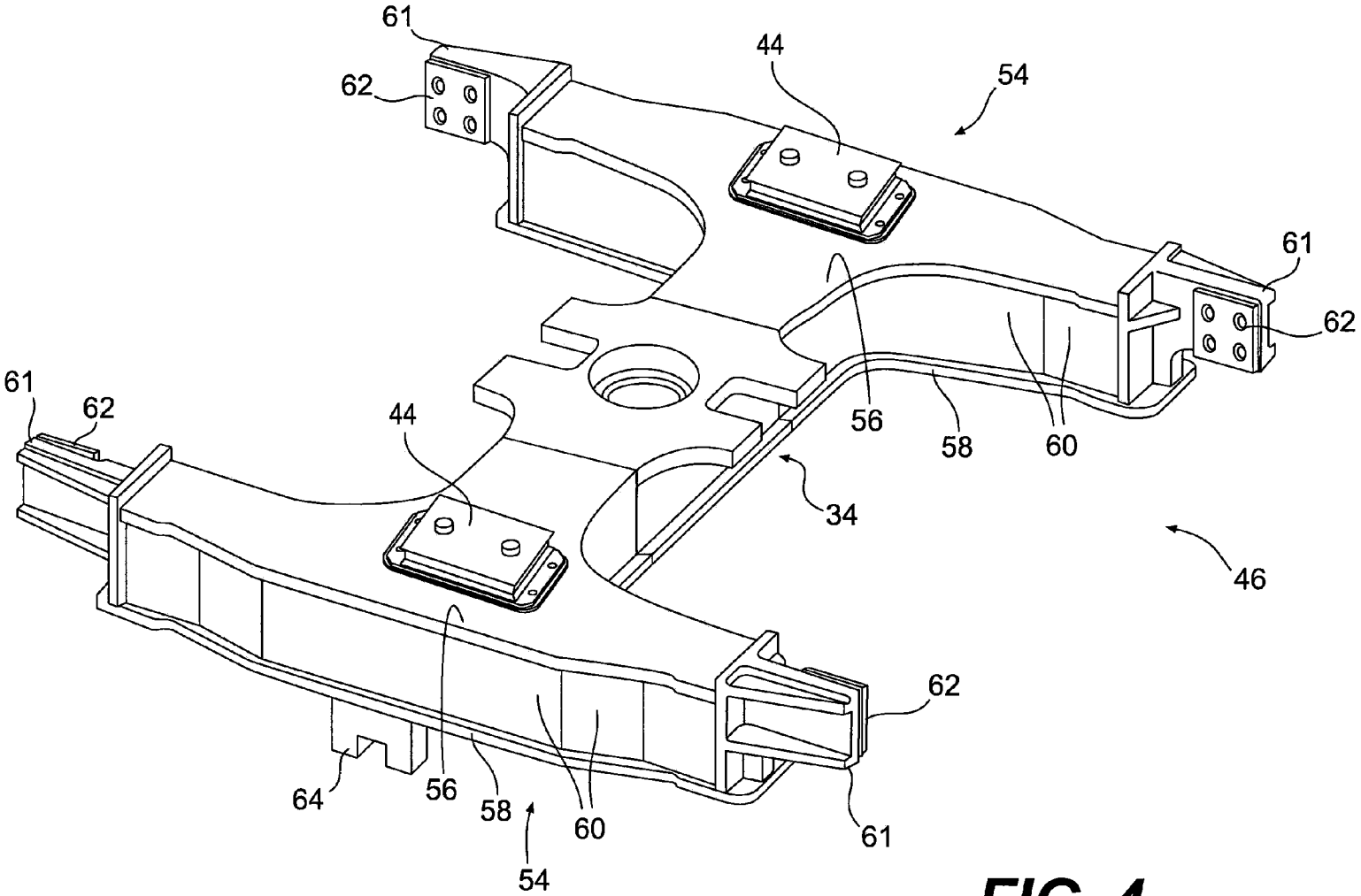
FIG. 4 is a pictorial illustration of an exemplary disclosed frame that may be used in conjunction with the bogie of FIG. 3.

FIG. 4 illustrates an exemplary embodiment of frame 46. As can be seen in this figure, frame 46 may be a fabrication of multiple components, including pivot housing 34 and substantially identical left and right arm members 54 that extend from pivot housing 34 in the lengthwise direction of bogie 36 to form a general H-shape. In this embodiment, pivot housing 34 may be an integral cast component having a center opening that is lined with a low-wear material, for example nylon, that is configured to receive pivot shaft 32 of bolster assembly 28 (referring to FIG. 2). Each of arm members 54 may be joined to opposing ends of pivot housing 34 by way of welding or mechanical fastening, as desired.

Arm members 54 may each include a generally planar top plate 56, a generally planar bottom plate 58, and a plurality of generally planar webs 60 that extend vertically between top and bottom plates 56, 58. Top plate 56, bottom plate 58, and webs 60 may be welded together to form a hollow enclosure that provides the required strength to bogie 36, while maintaining a low assembly weight. When arm members 54 are connected to pivot housing 34, top plates 56 of each arm member 54 may be generally co-planar with each other and with an upper surface of pivot housing 34. Likewise, bottom plates 58 of each arm member 54 may be generally co-planar with each other and with a lower surface of pivot housing 34. This flat, layered profile of frame 46 may help reduce packaging difficulties, help reduce part numbers and cost, and help increase a strength of bogie 36.

An end bracket 61 having a wear pad 62 (e.g., a nylon pad) oriented inward toward pivot housing 34 may be located at distal ends of each arm member 54. As shown in FIG. 4, each of the plurality of brackets 61 includes a first base plate with a rear face attached transversely to each forwardly facing end face of the distal ends of the first and second end members, and a second base plate on the first base plate and extending outward from the forwardly facing end face of the first base plate along a longitudinal direction of the first and second arm members. Wear pad 62 may be removably connected to machined surfaces of end bracket 61 and configured to engage bearing assembly 52 to laterally constrain bogie 36 and vertically limit movement of bogie 36 relative to wheels 24, as will be described in more detail below.

A notched bracket 64 may be formed at a lower side of each arm member 54, in general fore/aft alignment with pivot housing 34. Notched bracket 64 may be formed within a fabricated or cast component that is fixedly connected to bottom plate 58, for example by way of welding. Notched bracket 64, as will be described in more detail below, may be configured to transfer tractive forces between frame 46 and equalizer 50.

It is contemplated that frame 46 may include additional features associated with auxiliary components, if desired. For example, frame 46 could include one or more brackets and/or mounting plates configured to receive braking components, to accommodate motors 51 (shown as integral with pivot housing 34), to hang conduits or wiring, to support cooling ducts, etc. Although some of these additional features may be depicted in FIG. 4, these features will not be described in detail in this disclosure.

Figure 5:
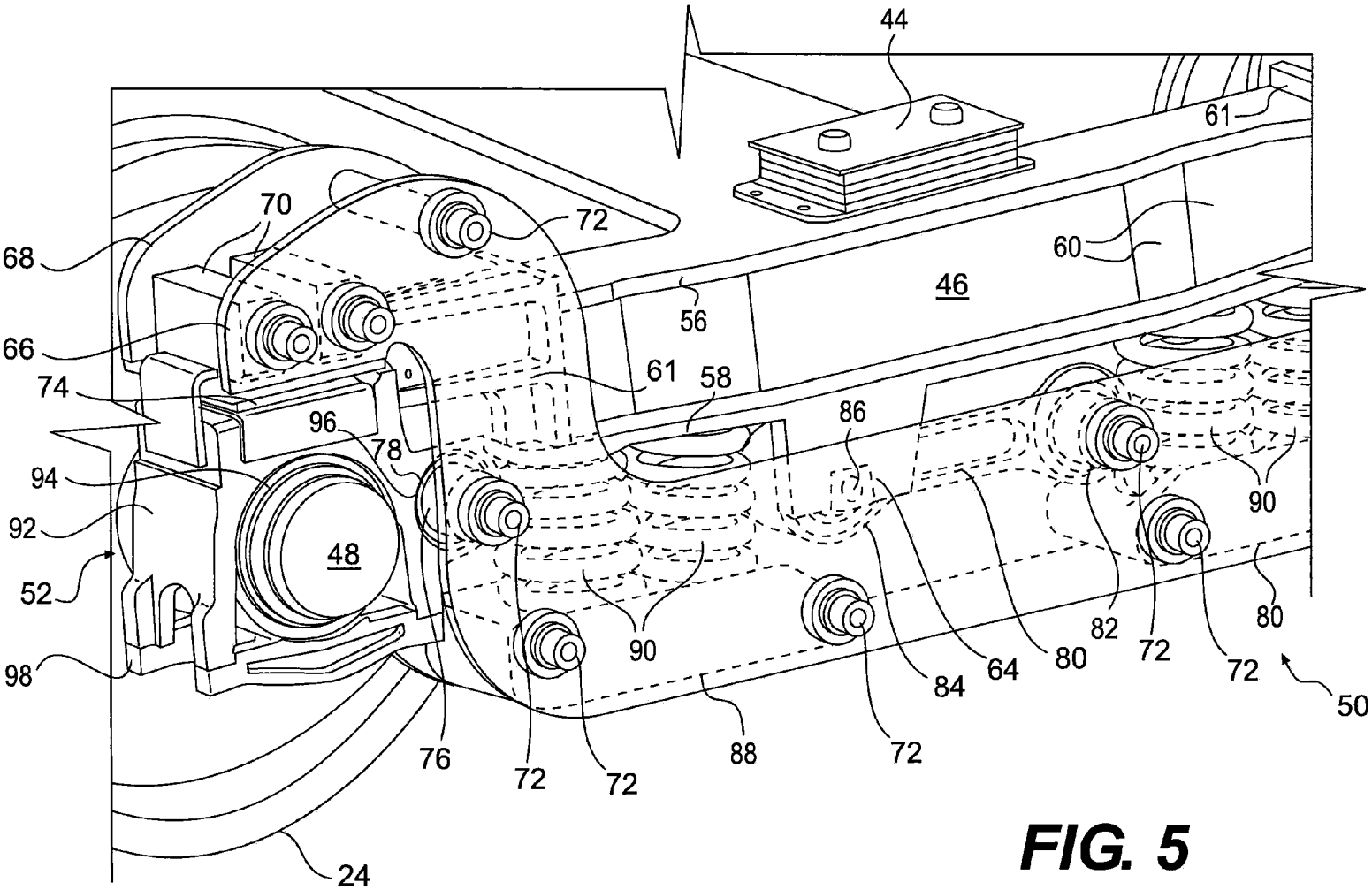
FIG. 5 is an enlarged pictorial illustration of a portion of the bogie of FIG. 3.

As shown in FIG. 5, equalizer 50 may be an assembly of components that together facilitate the transfer of forces between bearing assemblies 52 and frame 46. In particular, equalizer 50 may include, among other things, an outer plate 66 and a substantially identical inner plate 68 that are held apart from each other by one or more spacers 70 and clamped together by one or more rivets 72 or other fasteners. Each of outer and inner plates 66, 68 may be generally planar and fabricated as a single piece from flat stock in a general U-shape (seen in FIG. 2). The absence of welding between outer and inner plates 66, 68 of equalizer 50 may permit the use of high-strength materials that typically are inconvenient to weld. Opposing ends of equalizer 50 may rest atop front- and rear-located bearing assemblies 52 at a side of bogie 36, with a wear pad configuration 74 located between equalizer 50 and bearing assemblies 52. In this manner, vertical forces may be transferred between equalizer 50 and bearing assemblies 52 via wear pad configurations 74.

Equalizer 50 may be pinned to axles 48 by way of bearing assemblies 52 to transfer tractive forces between wheels 24 and equalizer 50. In particular, a pin 76 may be disposed between inner and outer plates 66, 68 at opposing ends thereof, and held in place by one of rivets 72. Pin 76 may be received within a rubber bushing 78 that is mounted within bearing assemblies 52, thereby constraining equalizer 50 relative to wheels 24 in the tractive direction, yet still allowing bearing assemblies 52 some ability to roll and yaw with respect to equalizer 50. Wear pad configurations 74 may further allow this relative rolling motion to occur through deflection when wheels 24 encounter irregularities in track 16.

Tractive forces may be transferred between equalizer 50 and frame 46 by way of a link 80. Link 80 may be positioned between outer and inner plates 66, 68 at a general lengthwise mid-portion, and pivotally held in place at a first end 82 by one of rivets 72. Link 80 may be pivotally connected at an opposing second end 84 to frame 46. In particular, a pin 86 may pass through second end 84 of link 80 and be clamped within notched bracket 64 by way of one or more vertically-oriented fasteners (not shown). When frame 46 and equalizer 50 are in equilibrium (i.e., not moving significantly relative to each other), link 80 may be generally horizontal. However, during relative movement between frame 46 and equalizer 50, link 80 may pivot in the vertical direction somewhat. In this configuration, link 80 may constrain frame 46 relative to equalizer 50 in the tractive direction, yet still allow some relative movement in the vertical direction through pivoting of link 80. In some embodiments, a rubber bushing (not shown) may be located within first and/or second ends 82, 84 to receive rivet 72 and/or pin 86, if desired. The rubber bushing may allow for some roll and/or yaw of frame 46 relative to equalizer 50.

One or more spring supports 88 may also be disposed transversely between outer and inner plates 66, 68 at a lower portion of equalizer 50 to facilitate vertical dampening of frame movement relative to equalizer 50. Spring supports 88 may embody plates that are held in a generally horizontal position by rivets 72, each support 88 being configured to receive a corresponding spring 90. Springs 90 may be sandwiched between equalizer 50 and an underside of frame 46 (i.e., between spring supports 88 and bottom plate 58). In this configuration, vertical forces may be transferred between frame 46 and equalizer 50 by way of springs 90.

Frame 46 may be laterally constrained and vertically limited relative to equalizer 50 by way of end brackets 61 located at the distal ends of arm members 54. In particular, end brackets 61 may be configured to engage an external surface of bearing assemblies 52, with wear pads 62 positioned therebetween. With end brackets 61 engaging bearing assemblies 52 on opposing sides of bogie 36, frame 46 may be constrained from transversely moving left or right relative to wheels 24. In addition, each of end brackets 61 may be located vertically between the portion of bearing assembly 52 that supports offset rubber bushing 78 at a lower side, and one of rivets 72 at an upper side. In this manner, excessive vertical movement of frame 46 may cause end brackets 61 to engage bearing assembly 52 and/or the rivet 72, thereby limiting further vertical movement of frame 46.

Figure 6:
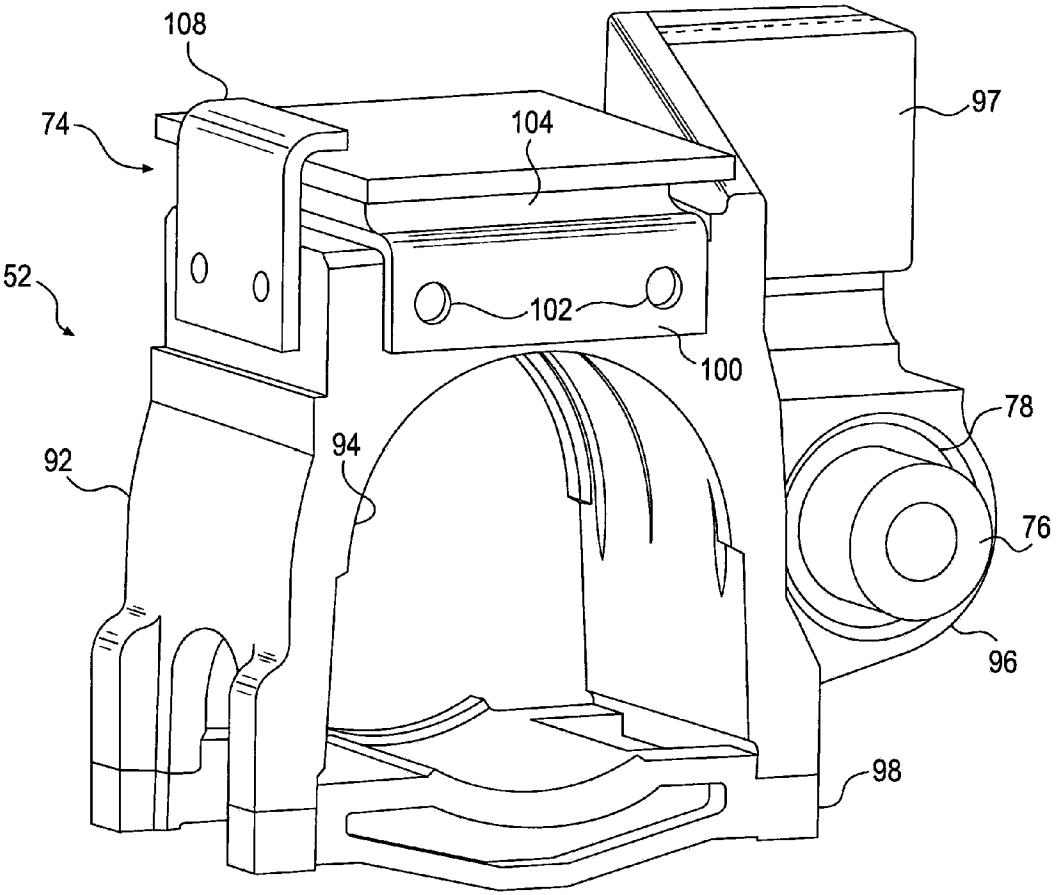
FIG. 6 is a pictorial illustration of an exemplary disclosed bearing assembly that may be used in conjunction with the bogie of FIG. 3.

As shown in FIG. 6, each bearing assembly 52 may include multiple components that cooperate to connect the associated equalizer 50 to a corresponding axle 48 (referring to FIG. 5). In particular, bearing assembly 52 may include, among other things, a housing 92 having a generally flat top that vertically supports ends of equalizer 50 via wear pad configuration 74, and a bottom portion forming a partial bore 94 configured to receive axle 48 and an offset bore 96 configured to receive rubber bushing 78. An additional wear pad 97 may be vertically mounted to housing 92 just above offset bore 96 and configured to mate against end brackets 61 of frame 46 (i.e., against wear pads 62 of frame arms 54). A cap 98 may engage housing 92 opposite the flat top to close off partial bore 94 and retain axle 48. Offset bore 96 may be offset inwardly relative to equalizer 50, such that equalizer 50 may be located between partial bores 94 of tandem bearing assemblies 52. A first bearing (not shown), for example a tapered roller bearing may be disposed within partial bore 94 and configured to support vertical and transverse loading of axle 48. Rubber bushing 78 may function as a second bearing disposed within offset bore 96 to receive pin 76 and support tractive and transverse loading of equalizer 50, while still allowing pivoting of pin 76 to accommodate roll and yaw differences between wheels 24 and equalizer 50. Housing 92 and cap 98 may be cast or fabricated components, as desired. Cap 98 may be joined to housing 92 by way of one or more vertically-oriented fasteners (not shown).

Wear pad configuration 74 may be a subassembly of components that together cushion relative movements between equalizer 50 and axles 48 (i.e., via bearing assembly 52). In particular, wear pad configuration 74 may include, among other things, a base plate 100 formed in a general U-shape and extending downward over the flat top of housing 92 to engage the front and back of housing 92. Sides of base plate 100 may include holes 102 configured to receive fasteners (not shown) that retain wear pad configuration 74 in place relative to housing 92. A compressed rubber pad 104 may be bonded to an upper surface of base plate 100, and an upper plate 106 may be bonded to a side of rubber pad 104 opposite base plate 100. In this configuration, an end of equalizer 50 (i.e., ends of outer and inner plates 66, 68) may rest on and be supported by upper plate 106, and wear pad 104 may shear and/or compress to allow relative movement between base and upper plates 100, 106. In one embodiment, the spacers 70 located between the ends of outer and inner plates 66, 68 of equalizer 50 (shown only in FIG. 5) may be welded or otherwise fixedly connected to upper plate 106, if desired. A motion limiter 108 may be mounted at an outside end of housing 92, relative to equalizer 50, and configured to limit motion of equalizer 50 in the vertical direction during extension of wear pad 104 that occurs during lifting of the truck assembly.

INDUSTRIAL APPLICABILITY

The disclosed railway truck may provide a means for transferring tractive, transverse, and vertical forces between the wheels and the car body of a locomotive with reduced wear of components. This reduction of component wear may help to extend the useful life of the locomotive as well as reducing service costs. The transfer of forces between wheels 24 and car body 12, as well as servicing requirements of locomotive 10 will now be described.

During operation of locomotive 10, motors 51 may be powered by engines 20, 22 to exert torque on wheels 24 via axles 48, thereby driving wheels 24 to propel locomotive 10. Reactionary forces associated with the forward or reverse motion of wheels 24 may be transferred from axles 48 to equalizers 50 by way of bearing assemblies 52, rubber bushings 78, and rivets 72 that hold rubber bushings 78. Equalizers 50, having received these tractive forces from axles 48 at both ends, may transfer these forces to frame 46 via rivets 72 associated with links 80, pins 86, and notched bracket 64 located with each arm member 54 of frame 46. From arm members 54, the tractive forces may move inward through pivot housing 34 to pivot shaft 32 within bolster assembly 28, and from pivot shaft 32 through span bolster 30 and center bearing 26 to pivot shaft 25. These tractive forces may then move from pivot shaft 25 through base platform 18 to car body 12. Reactionary tractive forces may then travel in reverse direction through these same components back to wheels 24.

As locomotive 10 travels along tracks 16, transverse irregularities in tracks 16 and/or a curving trajectory of tracks 16 may exert transverse forces on wheels 24. These transverse forces may travel from wheels 24 through axles 48 and bearing assemblies 52 to arm members 54 of frame 46 by way of wear pad 97 attached to housing 92 and wear pads 62 connected to end brackets 61 of arm members 54. The path used to transfer transverse forces from frame 46 to car body 12 may be the same path taken by tractive forces described above. Reactionary transverse forces may then travel in reverse direction through these same components back to wheels 24.

Car body 12 and all components between car body 12 and wheels 24 may exert vertical forces on wheels 24 that can change based on vertical irregularities and/or vertical trajectory changes of tracks 16. Wheels 24 may support these vertical forces by way of axles 48, bearing assemblies 52, equalizers 50, frame 46, and springs 44, 38. In particular, wheels 24 may transfer vertical forces with bearing assemblies 52 via axles 48. Equalizers 50, resting atop bearing assemblies 52, may transfer the vertical forces therewith via wear pad configurations 74. The vertical forces may be transferred between equalizers 50 and arm members 54 of frame 46 via spring supports 88 and springs 90. Frames 46 may transfer vertical forces with bolster assembly 28 via springs 44, while bolster assembly 28 transfers vertical forces with base platform 18 and car body 12 via springs 38.

During the transfers of forces described above, the different components of locomotive 10 may move relative to each other. For example, the ends of equalizers 50 may rock (i.e., yaw and roll) somewhat relative to the tops of bearing assembly 52 due to the bushing/pin connection therebetween. Similarly, frame 46 may move fore/aft and/or side-to-side somewhat relative to equalizers 50 due to the pin/link connection therebetween. Similarly, frame 46 of each bogie 36 may pivot relative to span bolster 30, while span bolster 30 may pivot relative to base platform 18 and car body 12.

All of the motion described above may cause wear that can be accommodated via easily replaceable components. For example, wear pad configurations 74 located between the ends of equalizers 50 and bearing assembly 52 may be periodically replaced at a relatively low cost to help avoid metal-to-metal contact therebetween, which would normally result in very expensive re-machining in conventional systems. Similarly, wear pads 62 located between end brackets 61 and wear pads 97 of housing 92, may be periodically replaced to help avoid metal-to-metal contact therebetween. Springs 38 and 44 may likewise be periodically replaced to help maintain desired spacing and vertical bias between frames 46 and bolster assembly 28 and between bolster assembly 28 and base platform 18.

It will be apparent to those skilled in the art that various modifications and variations can be made to the disclosed railway truck without departing from the scope of the disclosure. Other embodiments of the railway truck will be apparent to those skilled in the art from consideration of the specification and practice of the railway truck disclosed herein. It is intended that the specification and examples be considered as exemplary only, with a true scope of the disclosure being indicated by the following claims and their equivalents.

What is claimed is:

1. A frame for a railway truck, comprising:

a pivot housing;

a first arm member extending outward from the pivot housing and having opposing distal ends;

a second arm member substantially identical to the first arm member and extending outward from the pivot housing opposite the first arm member; and brackets disposed at the distal ends of the first and second arm members, wherein the brackets disposed at the distal ends of the first arm member face inward toward the brackets disposed at the distal ends of the second arm member, wherein:

each of the first and second arm members includes a generally planar upper plate, a generally planar lower plate, and plurality of webs vertically disposed between the generally planar upper and lower plates;

each of the brackets includes a first base plate with a rear face attached transversely to each forwardly facing end face of the distal ends of the first and second end members and a second base plate on the first base plate and extending outward from the forwardly facing end face of the first base plate along a longitudinal direction of the first and second arm members; and an upper surface of the pivot housing is generally coplanar with the generally planar upper plates of the first and second arm members.

2. The frame of claim 1, wherein the pivot housing, the first arm member, and the second arm member together form a general H-shape.

3. The frame of claim 1, wherein the pivot housing is an integral cast component.

4. The frame of claim 3, wherein the first and second arm members are component assemblies fabricated through welding.

5. The frame of claim 4, wherein the brackets are cast components.

6. The frame of claim 1, further including a plurality of wear pads removably connected to the brackets.

7. The frame of claim 1, further including a notched bracket attached at a lower surface of the first and second arm members that is configured to engage a tractive force-transferring link.

8. The frame of claim 1, further including a plurality of springs removably connected to outer surfaces of the generally planar upper plates.

9. A frame for a railway truck, comprising:

a pivot housing;

a first arm member extending outward from the pivot housing and having opposing distal ends;

a second arm member substantially identical to the first arm member and extending outward from the pivot housing opposite the first arm member; and a plurality of brackets connected to the distal ends of the first and second arm members, wherein each of the plurality of brackets includes a first base plate with a rear face attached transversely to each forwardly facing end face of the distal ends of the first and second end members and a second base plate on the first base plate and extending outward from the forwardly facing end face of the first base plate along a longitudinal direction of the first and second arm members, and wherein the plurality of brackets connected to the distal ends of the first arm member faces inward toward the plurality of brackets connected to the distal ends of the second arm member.

10. The frame of claim 9, wherein the pivot housing, the first arm member, and the second arm member together form a general H-shape.

11. The frame of claim 9, wherein the pivot housing is an integral cast component.

12. The frame of claim 11, wherein the pivot housing includes motor mounts.

13. The frame of claim 11 wherein the first and second arm members are component assemblies fabricated through welding.

14. The frame of claim 13, wherein the brackets are cast components.

15. The frame of claim 9, further including a plurality of wear pads removably connected to the plurality of brackets.

16. The frame of claim 9, further including a notched bracket formed at a lower surface of the first and second arm members that is configured to engage a tractive force-transferring link.

17. The frame of claim 9, further including a plurality of springs removably connected to outer upper surfaces of the first and second arm members.

18. The frame of claim 9, wherein the first and second arm members are configured to attach to the railway truck between tandem axles of the railway truck.

19. A locomotive, comprising:

a car body;

a bolster assembly configured to pivotally support the car body; and a truck having a first bogie and a second bogie pivotally connected to opposing ends of the bolster assembly, wherein each of the first and second bogies includes:

a first axle having a first end and opposing second end;

a second axle having a first end and an opposing second end;

a plurality of wheels connected to each of the first and second axles;

a first equalizer operatively supported by the first ends of the first and second axles in a vertical direction;

a second equalizer operatively supported by the second ends of the first and second axles in the vertical direction; and a frame including:

a pivot housing;

a first arm member extending outward from the pivot housing and having opposing distal ends that are located between the first and second axles;

a second arm member substantially identical to the first arm member and extending outward from the pivot housing opposite the first arm member; and a plurality of brackets connected to the distal ends of the first and second arm members, wherein the plurality of brackets connected to the distal ends of the first arm member faces inward toward the plurality of brackets connected to the distal ends of the second arm member to engage internal surfaces of the first and second equalizers, wherein:

each of the upper and lower arm members includes a generally planar upper plate, a generally planar lower plate, and plurality of webs vertically disposed between the upper and lower plates; and an upper surface of the pivot housing is generally co-planar with the upper plates of the first and second arm members.

* * * * *